US009549252B2

(12) United States Patent
Suvanto

(10) Patent No.: US 9,549,252 B2
(45) Date of Patent: Jan. 17, 2017

(54) MICROPHONE APPARATUS AND METHOD FOR REMOVING UNWANTED SOUNDS

(75) Inventor: Mikko Veli Aimo Suvanto, Kankasala (FI)

(73) Assignee: Nokia Technologies Oy, Espoo (FI)

( * ) Notice: Subject to any disclaimer, the term of this patent is extended or adjusted under 35 U.S.C. 154(b) by 438 days.

(21) Appl. No.: 13/819,115

(22) PCT Filed: Aug. 27, 2010

(86) PCT No.: PCT/IB2010/053862

§ 371 (c)(1),
(2), (4) Date: Apr. 24, 2013

(87) PCT Pub. No.: WO2012/025794

PCT Pub. Date: Mar. 1, 2012

(65) Prior Publication Data

US 2013/0208923 A1 Aug. 15, 2013

(51) Int. Cl.

| | |
|---|---|
| ***G10K 11/16*** | (2006.01) |
| ***H04R 3/00*** | (2006.01) |
| ***G10K 11/178*** | (2006.01) |
| *G10L 21/0216* | (2013.01) |

(52) U.S. Cl.

CPC ..... *H04R 3/005* (2013.01); *G10K 11/178* (2013.01); *G10K 2210/129* (2013.01); *G10L 21/0216* (2013.01); *H04R 2410/05* (2013.01)

(58) Field of Classification Search

CPC ..... G10K 2210/11; G10K 11/178; G10K 11/1788; G10K 2210/129; G10K 2210/3045; G10K 2210/3226

See application file for complete search history.

(56) References Cited

U.S. PATENT DOCUMENTS

| | | | |
|---|---|---|---|
| 8,233,637 | B2 | 7/2012 | Phelps et al. |
| 8,284,958 | B2 | 10/2012 | Suvanto et al. |
| 2002/0034310 | A1 | 3/2002 | Hou |
| 2003/0210799 | A1 | 11/2003 | Gabriel et al. |

(Continued)

FOREIGN PATENT DOCUMENTS

| | | | |
|---|---|---|---|
| CN | 1568094 | A | 1/2005 |
| CN | 1619951 | A | 5/2005 |

(Continued)

OTHER PUBLICATIONS

Final Office Action received for corresponding Korean Application No. 2013-7007593, dated Sep. 30, 2014, 3 pages of Office Action and No English Language Translation available.

(Continued)

*Primary Examiner* — Duc Nguyen
*Assistant Examiner* — Kile Blair
(74) *Attorney, Agent, or Firm* — Harrington & Smith

(57) ABSTRACT

An apparatus comprises a first transducer configured to detect sound and generate a first signal based on the detected sound. The apparatus also comprises a second transducer configured to detect vibration and/or sound and generate a second signal based on the detected vibrations and/or sound. The second transducer is less acoustically responsive than the first transducer. The apparatus comprises an interface configured to send the first and second signals to a processor configured to modify the first signal on the basis of the second signal.

21 Claims, 6 Drawing Sheets

(56) References Cited

U.S. PATENT DOCUMENTS

| | | | | |
|---|---|---|---|---|
| 2007/0016896 | A1 | 1/2007 | Wittmer et al. | |
| 2007/0041588 | A1* | 2/2007 | Lin | 381/71.1 |
| 2007/0047744 | A1 | 3/2007 | Harney et al. | |
| 2007/0047746 | A1 | 3/2007 | Weigold et al. | |
| 2008/0019548 | A1 | 1/2008 | Avendano | |
| 2008/0175407 | A1* | 7/2008 | Zhang et al. | 381/92 |
| 2009/0185696 | A1 | 7/2009 | Horibe et al. | |
| 2010/0026858 | A1 | 2/2010 | Kanamori | 348/241 |
| 2010/0183167 | A1 | 7/2010 | Phelps et al. | |

FOREIGN PATENT DOCUMENTS

| | | | |
|---|---|---|---|
| CN | 101569209 | | 10/2009 |
| EP | 1367853 | A1 | 12/2003 |
| JP | 2009171315 | | 7/2009 |
| KR | 10-0728189 | B1 | 6/2007 |
| KR | 2010-0053502 | A | 5/2010 |
| WO | 01/91511 | A1 | 11/2001 |
| WO | 2007106399 | A2 | 9/2007 |

OTHER PUBLICATIONS

Notice of Allowance received for corresponding Korean Application No. 2013-7007593, dated Nov. 10, 2014, 2 pages and 1 page of Notice of Allowance translation.

International Search Report and Written Opinion received in corresponding Patent Cooperation Treaty Application No. PCT/IB2010/053862. Dated Apr. 27, 2011. 11 pages.

Office Action received for corresponding Chinese Application No. 201080069488.3, dated Dec. 2, 2014, 9 pages of Office Action and 6 pages of office action translation.

Office Action received for corresponding Korean Application No. 2013-7007593, dated Apr. 15, 2014, 7 pages.

Office Action received for corresponding Chinese Application No. 201080069488.3, dated Mar. 24, 2014, 8 pages.

* cited by examiner

MICROPHONE APPARATUS AND METHOD FOR REMOVING UNWANTED SOUNDS

RELATED APPLICATION

This application was originally filed as PCT Application No. PCT/IB2010/053862 filed Aug. 27, 2010.

FIELD OF THE APPLICATION

The present application relates to a method and apparatus. In some embodiments the method and apparatus relate to a microphone component of an electronic device.

BACKGROUND OF THE APPLICATION

Some electronic devices comprise microphone components for capturing audio. A microphone component of an electronic device is typically integral with the electronic device and is located within the electronic device such that audio from the surrounding environment of the electronic device is captured.

The microphone component of the electronic device may comprise a membrane which moves in response to sound incident thereon. The movement of the membrane is detected and circuitry of the microphone component may generate an audio signal.

When capturing audio from the environment of the electronic device the membrane of the microphone component may be subject to other vibrations of the electronic device. For example, structural born mechanical vibrations of the electronic device can cause movement of the membrane. The movement of the membrane due to mechanical vibrations may be converted into the audio signal. This means that mechanical vibrations such as handing of the electronic device, movement of other components within the electronic device or other external mechanical vibrations of the electronic device are represented as noise in the audio signal. The noise in an audio signal not due to sound can therefore significantly deteriorate the audio signal which may result in a bad user experience.

It is known to isolate a microphone from mechanical vibrations of an electronic device using vibration dampening material such as rubber gaskets immediately around the microphone component. However some electronic devices are small in size and the amount of space available within the electronic device to fit vibration dampening material is limited. This means effectively isolating mechanical vibration from small and lightweight microphone components in small electronic devices can be difficult to achieve.

Another known mechanical arrangement mounts a microphone component on a floating back plate. The back plate is designed to vibrate together with the microphone component when the electronic device experiences mechanical vibrations. However, the differing masses of the back plate and membrane of the microphone component can cause a mismatch in the frequency response of the back plate and the frequency response of the membrane. A frequency response mismatch can lead to poor noise cancelling performance. Additionally the performance of the microphone component in an environment where the electronic device is not subject to mechanical vibrations may be degraded due to the floating back plate.

An alternative known arrangement detects the movement of an electronic device using acceleration sensors. The acceleration of the electronic device is detected and matched with an audio signal generated by the microphone component to determine which "noises" in the audio signal are due to mechanical vibrations. Digital signal processing is then applied to the audio signal in order to remove audio signals generated when the electronic device is subject to mechanical vibrations. However, the acceleration sensors can have different vibration sensitivities from the microphone membrane component at various frequencies of mechanical vibration, which can lead to poor noise cancelling performance. Furthermore production of a microphone component comprising both a membrane and an accelerometer can require non-optimal manufacturing solutions which may be costly.

Noise cancelling microphones can be used where clear communication in noisy ambient environments is required. Noise cancelling microphone designs may be a passive noise cancelling microphone or an active noise cancelling microphone.

An active noise-cancelling microphone may comprise two individual microphone elements and a circuit element for electronically differentiating two signals from the two microphone elements. The two microphone elements are arranged such that a first microphone element receives the desired speech input and the background noise present in the vicinity of the speech, and a second microphone element senses substantially only the background noise. Therefore, a noise reduced speech signal can be generated when subtracting the second microphone signal from the first microphone signal by the circuit element of the active noise-cancelling microphone.

The active noise-cancelling microphone system may use a built-in calibration function to calibrate the two microphones based on relative signal levels from the microphones. During the operation of the noise-cancelling microphone system output values of the microphones are monitored. The active noise-cancelling algorithm determines that any difference in signal level of the two microphones is due to acoustical pressure wave level differences. However, if there is a change in one microphone output caused by temperature change, and the calibration function does not compensate, then the noise cancelling algorithm would not be performing as well as expected. In fact, any condition that changes the sensitivities of the two microphones differently relative to the calibrated value will deteriorate the performance of the entire system. The sensitivity difference of the microphones in relation to each other can be caused by a relatively fast temperature difference between the microphones. This can be caused, for example, by a power amplifier in the device that heats the other microphone to e.g. 50 degrees centigrade. If the microphones are not identical they will react differently to changes in ambient temperature and this causes the sensitivity change in one more than in the other.

An alternative known arrangement is shown in FIG. 4. The arrangement involves a direct digital microphone that is constructed of a plurality of first membranes 420 each formed by a micro-machined mesh supported by a substrate 470. A second membrane 410 and a plurality of first membranes 420 are located in two different positions. A direct digital microphone that is constructed of the plurality of first membranes 420 is comprised of individual first membranes 460. The second membrane 410 is supported by a substrate 470 and positioned above the plurality of first membranes 420 to form a chamber 430 between the plurality of first membranes 420 and the second membrane 410. A pressure sensor 440 is responsive to pressure in the chamber 430. Drive electronics 450 are responsive to the pressure sensor 440 and control the positions of the plurality of first membranes 420. Polling electronics 450 are responsive to the positions of the plurality of first membranes 420 and produce a digital output signal.

Another known arrangement is shown in FIG. 5. The arrangement comprises at least two membranes with one membrane being desensitized as compared to the other membrane. Neither of these membranes are stacked, and the arrangement allows for the recording of audio at high SPL levels without saturation. There is a higher noise floor of the desensitized membrane and a smaller SNR.

The arrangement of FIG. 5 allows for operation of a mobile device during noisy conditions such as those due to wind, traffic, a crowd, etc. A high-pass electrical filter can be implemented between a microphone capsule and an ASIC in order to allow for operations in windy conditions. This, however, is an imperfect solution for at least three reasons: 1) the microphone output signal is often already saturated by wind noise, 2) the demands of preferred audio quality in non-windy environment require the high-pass filter to be set at a point which will still pass a large proportion of the wind noise, and 3) this strategy is not possible with digital microphones. Attempts have been made to use DSP circuitry to clean a windy signal from a multiple array of microphones but they have had limited effectiveness. Each membrane has a different sensitivity and each outputs a separate signal. In this example, only the signal from the less sensitive membrane has an acceptable distortion level, only that signal is selected for further processing and the other signal, which may be overly distorted due to signal clipping as the high-amplitude sound field exceeds the full scale output of the membrane and ADCs, is disregarded/dumped. Additionally, there may also be a high pass filter on one or both signal paths which can be selectively activated based on wind noise levels. The filter on the signal path that is continued may be activated to further reduce wind noise in some instances where the signal is additionally distorted in this way.

Embodiments of the application aim to address one or several of the above issues.

SUMMARY OF THE APPLICATION

In one embodiment of the application there is provided an apparatus comprising: a first transducer configured to detect sound and generate a first signal based on the detected sound; and a second transducer configured to detect vibration and/or sound and generate a second signal based on the detected vibrations and/or sound, the second transducer being less acoustically responsive than the first transducer; and an interface configured to send the first and second signals to a processor configured to modify the first signal on the basis of the second signal.

Preferably the first and second transducers are of the same type.

Preferably the apparatus comprises a modifying module configured to modify the first signal on the basis of the second signal. More preferably the modifying module is configured to subtract the second signal from the first signal.

Preferably the second transducer is configured to detect unwanted vibrations comprising one or more of the following: vibrations of the apparatus, wind noise and handling of the apparatus and unwanted sound.

Preferably the first transducer and the second transducer are adjacent to each other. The first transducer and the second transducer may be located on the same substrate. The substrate may be an mircoelectromechanical system chip.

Preferably the second transducer is substantially acoustically isolated from the apparatus. More preferably the second transducer is acoustically isolated from the apparatus. Even more preferably a cover is located over the second transducer and substantially acoustically isolates the second transducer from the apparatus. Preferably the cover is adhered to the second transducer. Preferably a vacuum or partial vacuum is located in the space where a membrane of the second transducer moves.

Preferably the apparatus comprises a first interface for sending the first signal on a first channel and a second interface for sending the second signal on a second channel.

Preferably the modifying module comprises an aligning module configured to align the phases of the first signal and the second signal. Additionally or alternatively the modifying module may comprise an aligning module configured to align the amplitudes of the first signal and the second signal.

Preferably the frequency response of the first transducer is substantially the same as the frequency response of the second transducer. The second transducer may be desensitised to acoustic signals. Alternatively the second transducer may be responsive to one or more different frequency ranges to the first transducer. Preferably the second transducer is tuned to one or more frequency ranges corresponding to one or more frequency ranges of unwanted vibrations such as vibrations of the apparatus. Preferably the first transducer is tuned to one or more frequency ranges corresponding to one or more audio frequency ranges.

Preferably the first transducer and/or the second transducer comprise an microphone membrane.

Preferably the first signal is from at least one audio source and the second signal is from at least one other source other than the audio source. Preferably the at least one other source is a source of mechanical vibrations.

In another embodiment there is provided an apparatus comprising: means for detecting sound; means for generating a first signal based on the detected sound; means for detecting vibration and/or sound, the means for detecting vibration and/or sound being less acoustically responsive that the means for detecting sound; means for generating a second signal based on the detected vibrations and/or sound; and means for sending the first and second signals to a processor configured to modify the first signal on the basis of the second signal.

In yet another embodiment there is provided an apparatus comprising: at least one processor; and at least one memory including computer program code, the at least one memory and the computer program configured to, with the at least one processor, cause the apparatus at least to: detect sound with a first transducer and generate a first signal based on the detected sound; and detect vibration and/or sound with a second transducer and generate a second signal based on the detected vibrations and/or sound, the second transducer being less acoustically responsive than the first transducer; and send the first and second signals to a processor configured to modify the first signal on the basis of the second signal.

In another embodiment there is provided an apparatus comprising: a first transducer configured to detect sound and generate a first signal based on the detected sound; and a second transducer configured to detect vibration and/or sound and generate a second signal based on the detected vibrations and/or sound, the second transducer being less acoustically responsive than the first transducer; and a processor configured to modify the first signal on the basis of the second signal.

In a further embodiment there is provided an apparatus comprising: means for detecting sound; means for generating a first signal based on the detected sound; means for detecting vibration and/or sound, the means for detecting vibration and/or sound being less acoustically responsive that the means for detecting sound; means for generating a second signal based on the detected vibrations and/or sound; and means for modifying the first signal on the basis of the second signal.

In yet a further embodiment there is provided an apparatus comprising: at least one processor; and at least one memory including computer program code, the at least one memory and the computer program configured to, with the at least one processor, cause the apparatus at least to: detect sound with a first transducer and generate a first signal based on the detected sound; and detect vibration and/or sound with a second transducer and generate a second signal based on the detected vibrations and/or sound, the second transducer being less acoustically responsive than the first transducer; and modify the first signal on the basis of the second signal.

In another embodiment there is provided a method comprising: detecting sound with a first transducer; generating a first signal based on the detected sound; detecting vibration and/or sound with a second transducer, the second transducer being less acoustically responsive than the first transducer; generating a second signal based on the detected vibrations and/or sound; and sending the first and second signals to a processor configured to modify the first signal on the basis of the second signal.

In another embodiment there is provided a method comprising: detecting sound with a first transducer; generating a first signal based on the detected sound; detecting vibration and/or sound with a second transducer, the second transducer being less acoustically responsive than the first transducer; generating a second signal based on the detected vibrations and/or sound; and modifying the first signal on the basis of the second signal.

In another embodiment there is provided a method of manufacturing an apparatus comprising: locating a first transducer for detecting sound and generating a first signal based on the detected sound and a second transducer for detecting vibration and/or sound and generating a second signal based on the detected vibrations and/or sound on a substrate, the second transducer being less acoustically responsive than the first transducer; and connecting the first transducer and the second transducer to an interface for sending the first signal and the second signal to a means for modifying the first signal on the basis of the second signal.

In another embodiment there is provided a computer program comprising code means adapted to perform the steps of the methods when the program is run on a processor.

BRIEF DESCRIPTION OF THE DRAWINGS

For a better understanding of the present application and as to how the same may be carried into effect, reference will now be made by way of example to the accompanying drawings in which.

DETAILED DESCRIPTION

The following describes apparatus and methods for reducing the noise in an audio signal from mechanical vibrations experienced by an electronic device.

Figure 1:
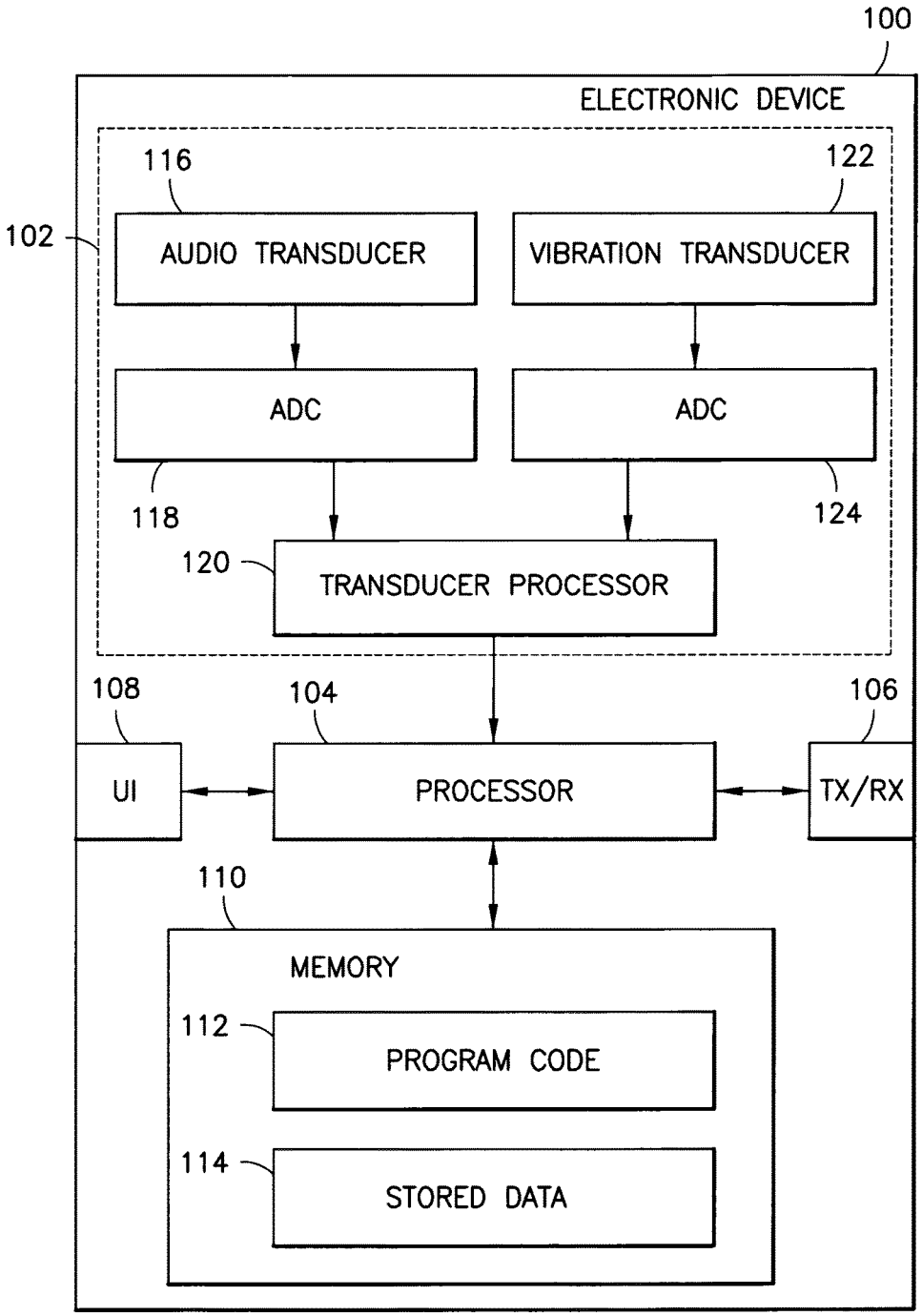
FIG. 1 illustrates a schematic diagram of some embodiments.

In this regard reference is made to FIG. 1 which discloses a schematic block diagram of an exemplary electronic device 100 or apparatus. The electronic device 100 is configured to reduce mechanical vibrations captured in an audio signal according to some embodiments.

The electronic device 100 is in some embodiments a mobile terminal, a mobile phone or user equipment for operation in a wireless communication system. In other embodiments, the electronic device is a digital camera, a camcorder, a portable dictation device, personal digital assistant (PDA), laptop or any other electronic device suitable for capturing sound.

The electronic device 100 comprises an audio module 102 which is linked to a processor 104. The processor 104 is linked to a transceiver (TX/RX) 106, to a user interface (UI) 108 and to memory 110.

The processor 104 in some embodiments can be configured to execute various program codes. For example, the implemented program code may comprise a code for controlling the audio transducer 116 to capture the sound. The implemented program codes, in some embodiments, comprise audio digital processing or configuration code. The implemented program codes in some embodiments further comprise additional code for further processing of audio signals. The implemented program codes can in some embodiments be stored, for example, in the memory 110 and specifically in a program code section 112 of the memory 110 for retrieval by the processor 104 whenever needed. The memory 110 in some embodiments can further provide a section 114 for storing data, for example, data that has been processed in accordance with the application.

The audio module 102 comprises an audio transducer 116 for capturing audio in the environment of the electronic device 100. The audio module 102 in some embodiments can be an application specific integrated circuit. In some embodiments the audio module 102 is integrated with the electronic device 100. In other embodiments the audio module 102 is separate from the electronic device 100. This means the processor 104 in some embodiments can receive a modified signal from an external device comprising the audio module 102.

The audio transducer 116 in some embodiments can comprise a dynamic or moving coil, a membrane or diaphragm, a piece of electric transducer, an electrostatic transducer or a transducer array, microelectromechanical systems (MEMS) microphone, electret condenser microphone (ECM) or any other suitable means or microphone components for capturing sound. Additionally or alternatively the transducer comprises a multi function device (MFD). In some preferred embodiments the audio transducer 116 is an MEMS microphone comprising a microphone membrane.

In some embodiments a MEMS microphone is used. A MEMS microphone offers some advantages over an electret condenser microphone (ECM), including advantages in manufacturability, production volume scalability and stability in varying environments, as non-limiting examples. It can be challenging to design an acoustically optimized MEMS microphone package because package design requirements are largely set by the mechanical interfaces of the device in which the MEMS microphone is to be used.

For example, the design requirements may depend on how and where the MEMS microphone is integrated in the device.

In some embodiments, the MEMS microphone comprises two chips: a MEMS chip and an application-specific integrated circuit (ASIC) chip. Both the MEMS and ASIC chips are mounted on a substrate PWB and are connected together with at least one bond wire. The microphone is incorporated in a casing that has one or more sound ports for receiving acoustic pressure waves. The MEMS chip includes a condenser microphone element etched in silicon. The ASIC chip includes a pre-amplifier, an analogue-to-digital converter and may further comprise a charge pump for biasing the MEMS microphone element. In some embodiments, the MEMS chip elements are included in the ASIC. The ASIC detects the capacitive variations, converts them into electrical signals and passes them to appropriate processing means (may be external to the microphone), such as a baseband processor or an amplifier.

In some embodiments the apparatus can include an ECM. In some embodiments the ECM comprises a vibrating diaphragm, a fixed back plate which is placed to be opposed to the vibrating diaphragm via an air layer; and a circuitry, such as an ASIC for converting an electrostatic capacity between the vibrating diaphragm and the fixed back plate to an electric signal. The microphone is incorporated in a casing that has one or more sound ports for receiving acoustic pressure waves. The ASIC and the casing are mounted on a substrate such as a printed wiring board (PWB). A spring connects the back plate to the PWB and thus the ASIC. The ASIC chip may comprise a pre-amplifier and/or an analogue-to-digital converter. The ECM also has external connecting means for leading out the electric signals (not shown). In some embodiments the ECM can include one or more MEMS microphones (e.g., MEMS microphone packages or modules), although some ECMs may not include MEMS microphones.

One important parameter of a microphone is sensitivity. Sensitivity of a microphone is defined as the output voltage for a specific acoustic stimulus and load condition. It may be expressed in dBV/pa. In case of a digital interface, the sensitivity can also be given in relation to the full scale signal expressed in dBFS.

In some embodiments the processor 104 is linked by a analogue-to-digital converter (ADC) 118 to the audio transducer 116. The analogue-to-digital converter (ADC) 118 can be any suitable converter. In some embodiments the processor 104 is further linked via a transducer processor 120 to the audio transducer 116. The transducer processor 120 is configured to modify audio signals received from the audio transducer 116 via the ADC 118. In some embodiments the audio transducer 116 can detect sound from the environment of the electronic device 100 and generate a signal which is sent to the analogue-to-digital converter (ADC) 118. The transducer processor 120 can be configured to execute signal processing algorithms for modifying the signals from the audio transducer 116 and the vibration transducer 122. The analogue-to-digital converter (ADC) 118 sends the digitised audio signal to the transducer processor 120 for modifying the audio signal. In some embodiments the transducer processor 120 is optional or not necessary because no modification of the audio or the vibration signals are required before they are combined. Alternatively, in some other embodiments the transducer processor 120 is not necessary because the processor 104 carries out the processes of the transducer processor 120 such as the modifying the audio signal. In some embodiments there is an integrated microphone comprising a microphone with an integrated analogue-to-digital converted and the integrated microphone outputs a digital sound signal.

The audio transducer 116 in some circumstances can be subjected to mechanical vibrations such as physical handling of the electronic device 100 by a user, key presses which generate a "click" sound and an associate mechanical vibration, or other vibrations caused by internal components of the electronic device, such as a camera actuator or moving components of a hard drive. The audio transducer 116 can in some embodiments also detect vibrations generated in an industrial environment, for example vibrations caused by heavy machinery or other vibrations. The electronic device 100 can in some embodiments also experience vibrations from a domestic environment such as vibrations generated from washing machines and other similar household appliances. For example the device can be sitting on a flat surface wherein the surface is receiving vibrations due to household appliances while person is doing teleconference/video call or a recording sound.

The mechanical vibrations incident at the audio transducer 116 can actuate the audio transducer 116 and cause the audio transducer 116 to generate an audio signal due to the mechanical vibrations. In this way the mechanical vibrations on the audio signal are represented in the audio transducer 116 output.

The audio module 102 in some embodiments further comprises a vibration transducer 122 for capturing mechanical vibrations which the electronic device 100 experiences. In some embodiments the vibration transducer 122 detects unwanted vibrations incident at the device. The unwanted vibrations can comprise mechanical vibrations of the apparatus. Alternatively or additionally the unwanted vibrations can comprise wind noise, acoustic sounds, vibrations due to handling and other vibrations of the apparatus. For example the vibration transducer 122 detects mechanical vibrations subjected to the electronic device 100 due to handling by a user or any of the sources of vibration previously mentioned. In some embodiments, the vibration transducer 122 comprises a dynamic or moving coil, a piece of electric transducer, an electrostatic transducer or a transducer array comprising microelectromechanical systems (MEMS) or any other suitable means or microphone component for capturing vibrations of the electronic device. In some preferred embodiments the vibration transducer 122 is an MEMS component comprising a microphone membrane.

Similar to the audio transducer 116, the vibration transducer 122 is connected to the transducer processor 120 via an analogue-to-digital converter 124. The analogue-to-digital converter 124 is similar to the analogue-to-digital converter 118.

In some embodiments the vibration transducer 122 is acoustically isolated to stop sound ingress from the environment of the electronic device 100. In some embodiments, the vibration transducer 122 detects mechanical vibrations, and substantially no sounds transmitted through the air. The vibration transducer 122 in some embodiments comprises a cover (not shown) over the membrane to isolate the vibration transducer 122 from the surroundings of the electronic device 100. The cover of the vibration transducer 122 means that the membrane of the vibration transducer 122 does not move in response to sound from outside of the electronic device 100. The cover can in some embodiments be adhered to the microphone membrane of the vibration transducer 122 or can in some embodiments be an integral part of the vibration transducer 122 which is created during manufacture.

In some embodiments the audio transducer 116 and the vibration transducer 122 are microelectromechanical systems (MEMS) comprising a movable membrane. The membrane of the audio transducer 116 and the vibration transducer 122 moves in response to vibrations of the air and/or the body of the electronic device and accordingly the transducers 122, 116 generate a signal.

Figure 3:
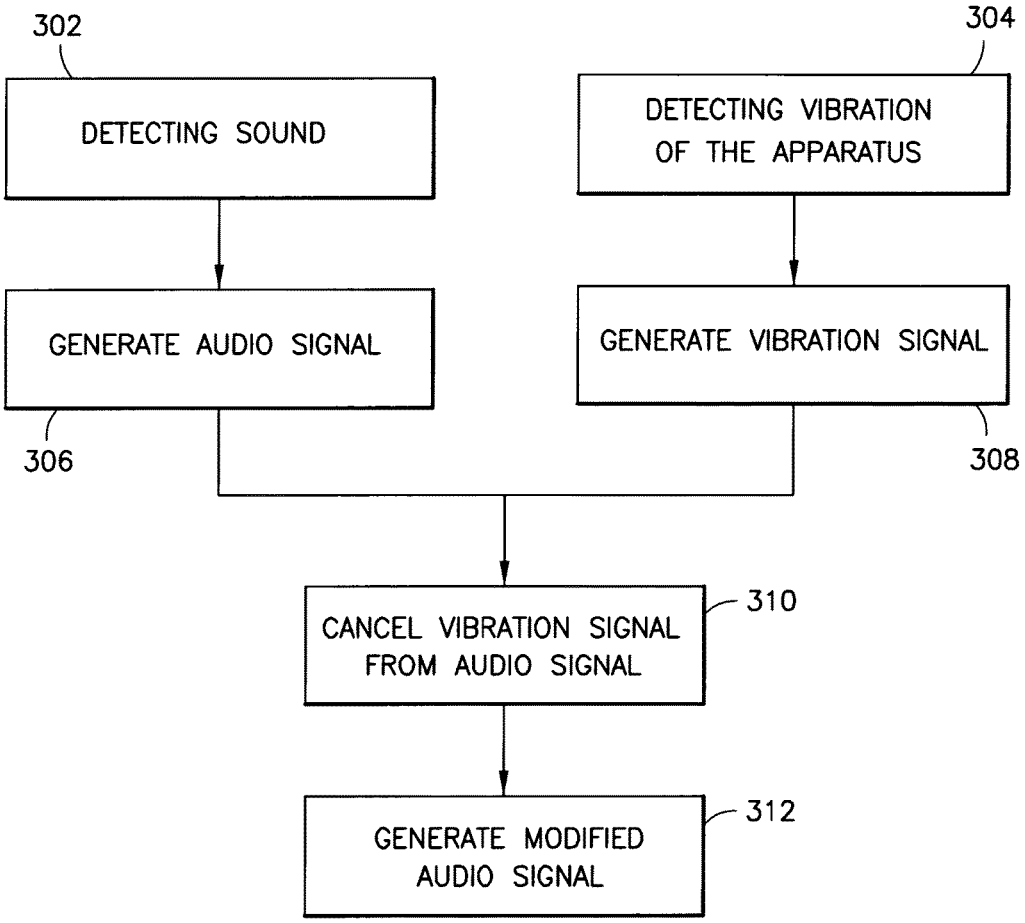
FIG. 3 illustrates a flow diagram of some embodiments.
Figure 4:
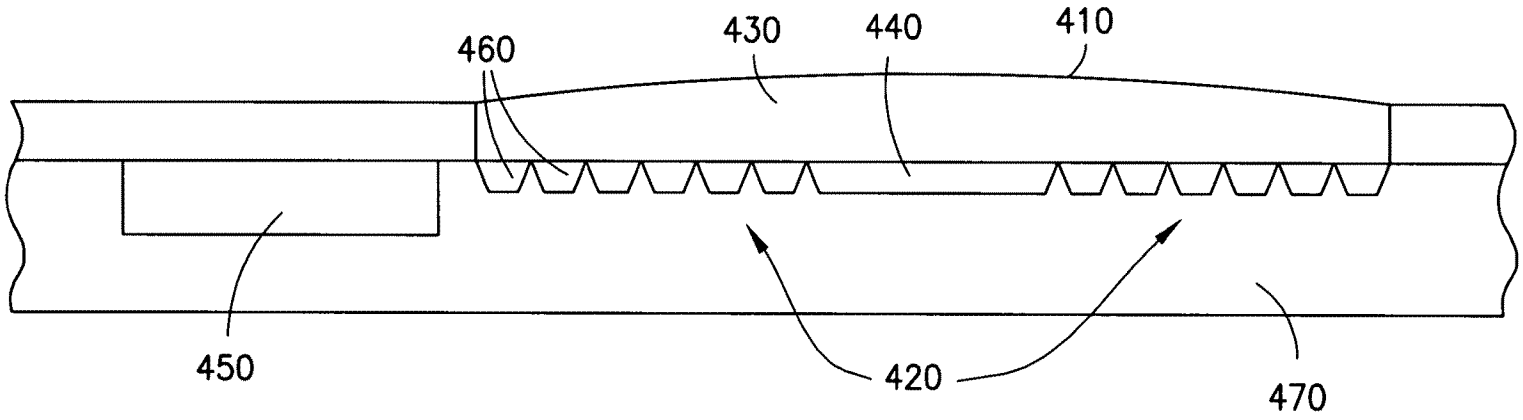
FIG. 4 illustrates an arrangement of a first microphone.
Figure 5:
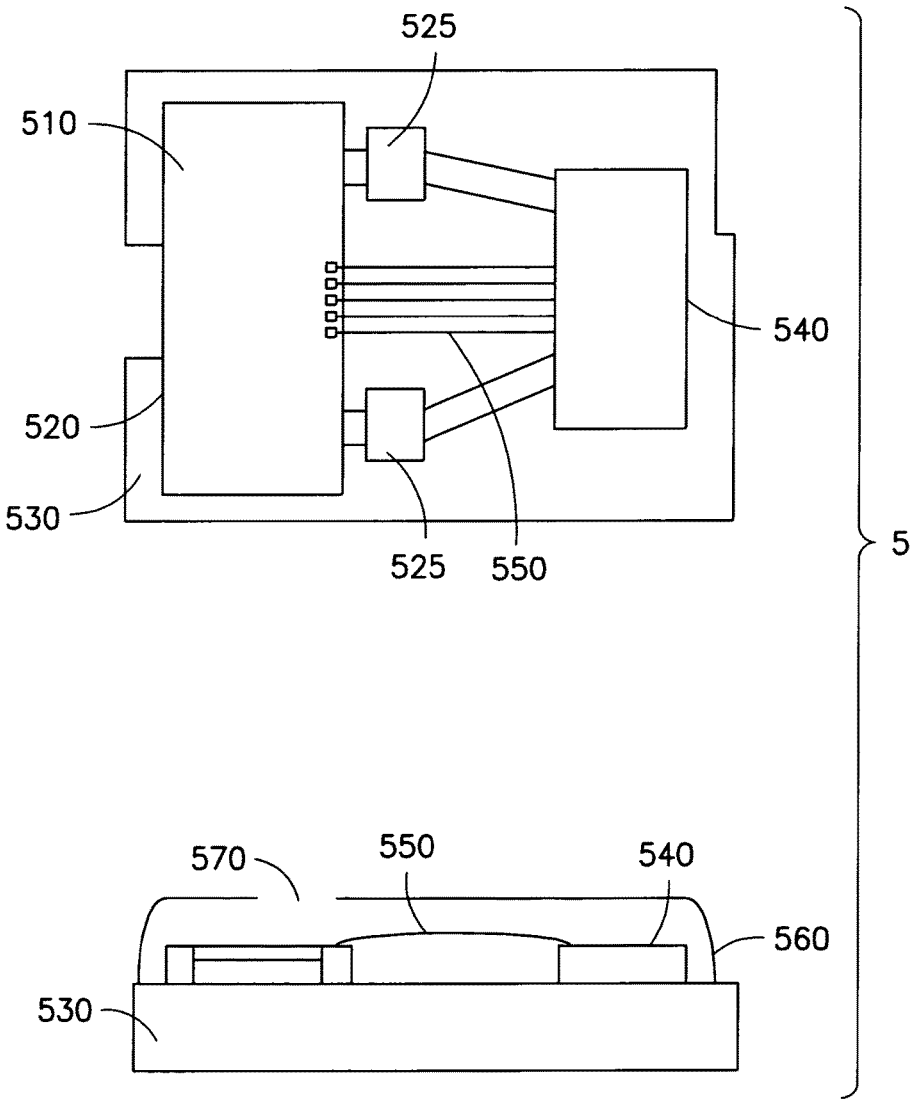
FIG. 5 illustrates an arrangement of a second microphone.

The implementation of detecting and modifying the audio signal with the electronic device as shown in FIG. 1 will now be described with reference to FIG. 3. FIG. 3 discloses a flow diagram illustrating some embodiments.

When sound is generated in the immediate environment of the electronic device 100, sound may ingress to an audio transducer 116 within the electronic device 100 via a suitable opening. The sound is detected at the audio transducer 116 as shown in step 302. The signal from the audio transducer 116 is then output to the analogue-to-digital converter 118 which generates the digital audio signal as shown in step 306.

In some embodiments, the analogue-to-digital converter 118 can be located inside or together with ASIC which can be positioned inside the microphone modules. In some other embodiments, the analogue-to-digital converter 118 can be located outside of the microphone module. For example the analogue-to-digital converter 118 is an element of the uplink chain wherein the microphone signal is suitably converted and with a suitably designed microphone module).

Figure 6:
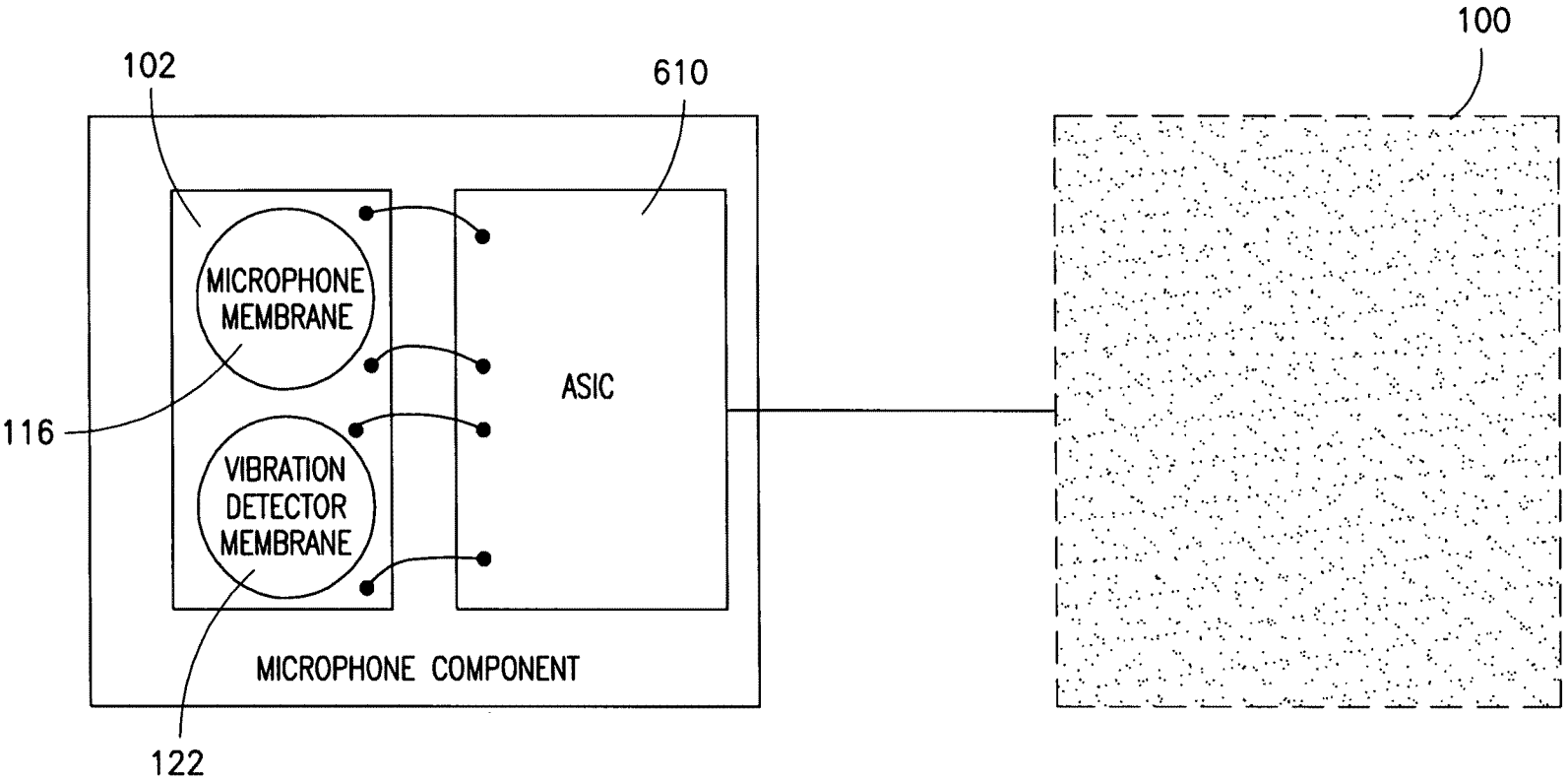
FIG. 6 illustrates a schematic diagram according to some other embodiments.

Some embodiments will now be described in reference to FIG. 6. FIG. 6 illustrates two schematic representations of some embodiments. In particular FIG. 6 illustrates an alternative embodiment whereby an audio module 102 comprises an MEMS microphone comprising an audio membrane 116 and a vibration membrane 122. The microphone component comprises an ASIC 610 comprising a processor configured to perform digital signal processing. The ASIC 610 performs the modification of the audio signal as discussed with respect to previously discussed embodiments and sends a modified signal to the electronic device 100.

In another embodiment there is provided the same arrangement as shown in FIG. 6 except that the ASIC 610 does not comprise digital signal processing capability. Instead the ASIC comprises an analog to digital converter and sends the audio signal and the vibration signal to the electronic device 100 for modifying.

The digital microphones of some embodiments can provide the output signal which is PDM (Pulse Density Modulated). The PDM data is decimated (low-pass filtered) digitally in the ASIC to obtain the desired audio band. The decimation filter may be highly optimised for a 4th order sigma delta modulator. Any ADC topology generating similar kind of PDM spectra can be used. A digital microphone is essentially a regular microphone with integrated amplifier and sigma-delta type ADC converter in one component. In some embodiments there is a single ADC that can receive the summed signal.

The audio signal output from the audio transducer 116 via the ADC 118 comprises features in the audio signal which are not due to sound waves but mechanical vibrations of the electronic device 100.

The vibration transducer 122 detects mechanical vibrations of the electronic device 100 or the apparatus as shown in step 304. The vibration transducer 122 is acoustically isolated from the environment of the electronic device 100 and captures only the mechanical vibrations of the device 100. The vibration transducer 122 outputs an analogue signal to a digital-to-analogue converter 124 which generates a digital vibration signal of unwanted vibrations as shown in step 308. The digital vibration signal of unwanted vibrations can comprise signals associated with vibrations and/or sounds from a source other than the audio source associated with the audio signal. For example both 116 and 122 can record vibration and/sound signals, but the audio transducer 116 can be more sensitive to sound whereas the vibration transducer 122 can be acoustically isolated so that the sensitivity of the vibration transducer 122 is in a certain range of signals such as mechanical vibrations and/or possibly heavy/loud noises.

The transducer processor 120 receives the audio signal and the vibration signal for modifying the audio signal. The transducer processor 120 in some embodiments can be any suitable means for modifying the audio signal. The audio signal and the vibration signal are sent to the transducer processor via an interface (not shown). In some embodiments the interface can be any means suitable for sending the audio signal and the vibration signal to the transducer processor.

In some embodiments the transducer processor can perform signal processing on the vibration signal received from the vibration transducer 122. In some embodiments the vibration signal can be amplified by the transducer processor 120 in order that the mechanical vibration features in the audio signal are matched to the vibration signal. This means that the vibration signal can be subtracted from the audio signal removing all of the audio features from the audio signal due to the mechanical vibrations of the electronic device 100. In some embodiments such processing, vibration cancellation, can be completed both in the time domain or frequency domain or both.

In other embodiments, the vibration signal can be attenuated by the transducer processor for matching the vibration signal with the audio signal. In some other embodiments the transducer processor 120 can additionally or alternatively delay the vibration signal with respect to the audio signal in order to match the audio and vibration signals in the time domain.

After the transducer processor 120 has modified the timing and/or amplitude of the audio and vibration signals, the transducer processor 120 subtracts the vibration signal from the audio signal as shown in step 310. In this way, the transducer processor cancels the mechanical vibration features present in the audio signal received from the audio transducer 116. In some embodiments no modification may be needed by the transducer processor 120. Instead the transducer processor 120 may perform an operation such as filtering and/or mathematical operation in order to cancel unwanted signals without modifying either signals from the audio transducer 116 and the vibration transducer 122.

The transducer processor 120 then generates a modified audio signal from the combination of the audio and vibration signals and outputs the modified audio signal to the processor 104 as shown in step 312. The processor 104 can in some embodiments store the modified audio signal in memory 110 or can send the modified audio signal to another device.

In some embodiments there can be a switch for or activation mechanism for the vibration transducer 122. The modification of the audio signal can only take place if the switch is activated. To improve processing power or reduce complexity or improve battery life, the system may only use vibration transducer if and when needed. For example, a user also can possibly activate or alternatively the activation can be done intelligibly by the system.

Figure 2:
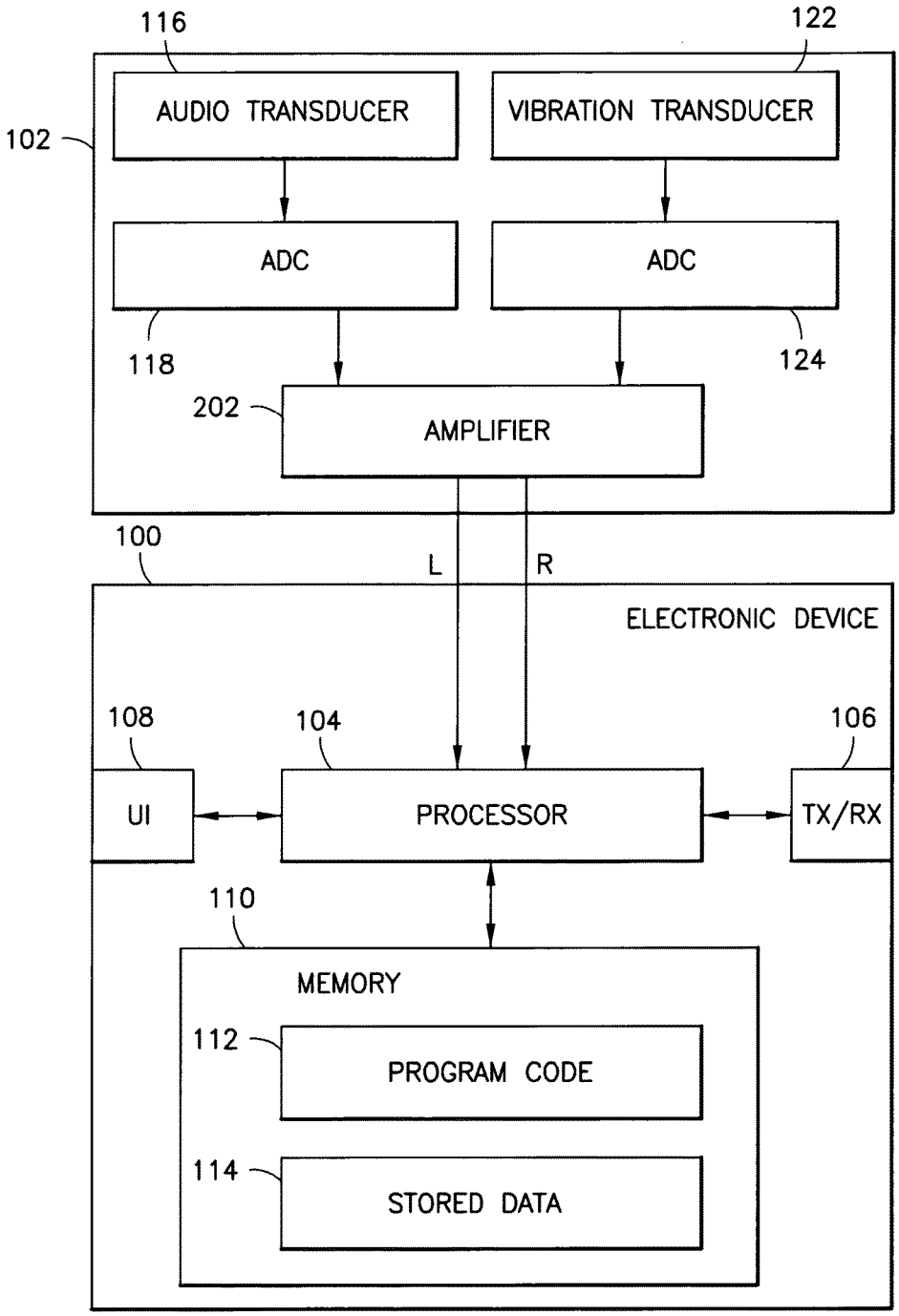
FIG. 2 illustrates a schematic diagram of other embodiments.

Some other embodiments are now described with reference to FIG. 2. FIG. 2 illustrates a schematic diagram of some embodiments comprising an electronic device 100 and an audio module 102 wherein the audio module and the electronic device are separate.

The electronic device is similar to the electronic device as described with reference to FIG. 1. The features of FIG. 2 which are the same as the features of FIG. 1 have been numbered using the same numbering used in FIG. 1.

The audio module 102 can in some embodiments be remote from the electronic device 100. For example, in some embodiments the audio module 102 can be comprised in a microphone element in a headset.

The audio module 102 comprises an amplifier which amplifies the audio signal from the audio transducer 116 and/or the vibration signal from the vibration transducer 122.

In some embodiments there is an optional dedicated transducer processor (not shown) for receiving the signals from the audio module 102 and processing the signals and sending the modified signals to the processor 104. In some other embodiments the processor 104 can in some embodiments receive the signals from the amplifier 202 over a data line comprising two channels. In some embodiments, the amplification can include signal processing. In some embodiments the amplification can be contained in an ASIC. In some embodiments the signals are passed to the amplifier 202 whenever necessary. For example, the audio module may determine that the signals from the transducers do not need amplification and the audio module 102 can pass the signals to the electronic device 100. The processor 104 further can in some embodiments receive the audio signal over a first channel and receives the vibration signal over a second channel. The processor 104 can be configured to cancel the vibration signal from the audio signal and generate a modified audio signal as shown in steps 310 and 312 similar to the embodiments discussed with respect to FIG. 1. In this way the apparatus does not comprise an application specific integrated circuit, but instead the processor of the electronic device carries out the signal processing of the audio signal.

The embodiments discussed with respect to FIG. 2 can use existing digital microphone interface. For example, existing microphone components can in some embodiments comprise two transducers for capturing stereo audio. In some embodiments a microphone interface for stereo audio capture can be used for sending the audio signal and the vibration signal on separate channels. In some embodiments the audio signal is sent over a left channel and the vibration signal is sent over the right channel (or vice versa). This can reduce the amount of required signal lines between microphone components and the electronic device 100.

In some embodiments the audio transducer 116 and the vibration transducer 122 are manufactured on the same microphone component. In some alternative embodiments the audio transducer 116 and the vibration transducer 122 can be manufactured on separate microelectromechanical system (MEMS) chips. The audio transducer 116 and the vibration transducer in such embodiments are located next to each other so that the vibration transducer 122 detects the same mechanical vibrations as the audio transducer 116 experiences.

In some embodiments the audio transducer 116 and the vibration transducer 122 are manufactured using the same process. In some further embodiments the audio transducer 116 and the vibration transducer 122 are the same type of transducer.

In some embodiments the audio transducer 116 and the vibration transducer 122 are located on one microelectromechanical system (MEMS) chip. The audio transducer 116 and the vibration transducer 122 can in some embodiments comprise two identical microphone membranes. In this way, the sensitivity of the vibration transducer 122 and the audio transducer 116 can be aligned. The vibration transducer 122 comprises a cover or lid which can be mounted on the microelectromechanical system chip after the two microphone membranes have been created on the chip. In this way, a signal microelectromechanical system chip can in some embodiments comprise two microphone membranes for detecting vibrations, but one of the membranes comprises a cover for sealing the membrane of the vibration transducer 122 and acoustically isolating the vibration transducer 122 from the environment of the electronic device 100.

In some embodiments the stiffness of the membrane of the sealed vibration transducer 122 can be greater than the stiffness of the membrane of the audio transducer because of the cover isolating the vibration transducer 122. The stiffness of the audio transducer 116 and the vibration transducer 122 can be adjusted to be substantially equal to each other by acoustically isolating the vibration transducer 122 with the cover in a vacuum or a partial vacuum. Additionally, the presence of a vacuum or partial vacuum between the cover and the membrane of the vibration transducer means that sound transmitted in the air does not substantially actuate the membrane of the vibration transducer 122. In some embodiments, a first membrane of the audio transducer 116 is designed to be sensitive which is similar to those are used in conventional microphone modules. The second membrane of the vibration transducer 122 may be de-sensitized as compared to the first membrane. Furthermore, there may be a substantial sealing around the second membrane in order to eliminate the membrane against acoustic signals.

Advantageously manufacturing a microelectromechanical system (MEMS) chip comprising two almost identical membranes having a similar design, and manufacturing process can in some embodiments reduce phase difference between the audio transducer 116 and the vibration transducer 122.

In some embodiments a phase shift between the audio signal and the vibration signal can be detected by the transducer processor 120. If the transducer processor 120 determines that the audio signal and the vibration signal are out of phase, the transducer processor 120 delays the signal of one of the audio signal or the vibration signal with respect to the other signal. The transducer processor 120 delays the audio signal with respect to the vibration signal (or vice versa) by the amount the transducer processor 120 determines the signals are out of phase. In this way the transducer processor 120 removes the phase shift of the audio and the vibration signals by introducing a time delay. For example, circuitry providing a phase locked loop can in some embodiments be used to bring the audio signal and the vibration signal into phase. Alternatively, or additionally in some embodiments the transducer processor 120 determines the relative amplitudes of the audio signal and the vibration signal. If the transducer processor 120 determines that there is a difference between the relative amplitudes of the audio signal and the vibration signal, the transducer processor 120 can in some embodiments attenuate or the audio signal with respect to the vibration signal or vice versa. In some alternative embodiments, the processor 104 performs the signal processing instead of the transducer processor 120.

Advantageously some embodiments reduce mechanical vibrations represented in the audio signal. The arrangement of some embodiments does not require dampening means which requires a large footprint of the total size of the electronic device.

Some embodiments of the invention provide a good matching between the vibration sensitivities between the two membranes in the whole audio frequency band because they are the same type of sensor and they are made in the same process simultaneously. This means that the audio transducer 116 and the vibration transducer 122 have excellent time alignment which enables accurate noise cancellation.

In some embodiments the vibration transducer 122 detects vibrations in one dimension because the microphone component of the vibration transducer can move only along one axis. In particular the direction of the vibrations are detected in a direction which is perpendicular to the plane of the membrane of the vibration sensor. In other embodiments the vibration sensor 122 comprises a plurality of vibration transducers 122 which can be arranged to detect vibrations in more than one direction. In this way the transducer processor 120 can better detect the type of mechanical vibration the electronic device 100 experiences.

In some embodiments the vibration signals captured in the audio signal by the audio transducer can be cancelled by sending an anti-phase vibration signal captured in the vibration transducer to the audio transducer. The mechanical vibrations are cancelled from the MEMS microphone output and ASIC, DSP, ADC are configured suitably inside microphone packaging. The first membrane captures both the acoustic signal and vibrations and the vibrations are also captured at the second membrane. There may be various variations on how the cancellation of the vibration signal can be achieved. For example, cancellation of the vibration signal from the audio signal may be achieved in the device software and even a MEMS module or any other suitably designed microphone module may not include DSP, ADC. Furthermore, other embodiments can implement where ECM microphones even though the devices may be larger in size.

In some embodiments one of the available microphone modules and in particular digital microphones may comprise a five wire interface. The 5 wire interface may comprise five signals. One of the signal lines can be allocated for the audio transducer 116. In a similar manner, a similar signal line can be used for the vibration transducer 122. Since such mechanism is used in some devices already, such implementation may be straightforward without requiring significant effort and a simple adaptation may be possible.

A mechanism/switch (not shown) can be implemented between the outputs from both of the transducers and ASIC to allow for switching between the output from the audio transducer 116 to the vibration transducer 118 or vice versa in order to combine the outputs or select the signal from either of the membrane. The switching may be performed by user input or automatically via circuitry such as ASIC. For example, if there is no vibration signal detected or the signal level is below the threshold, then the system may not combine both signals in order to cancel the vibration signal from the output of the first membrane. This possibility may be considered as an effective solution in terms of processing power.

It shall be appreciated that the term electronic device and user equipment is intended to cover any suitable type of wireless user equipment, such as mobile telephones, portable data processing devices or portable web browsers.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits (such as field programmable gate array—FPGA circuits) and processors based on multi-core processor architecture, as non-limiting examples.

Embodiments of the inventions may be practiced in various components such as integrated circuit modules. The design of PWB and RF designs are by and large a highly automated process. Complex and powerful software tools are available for converting a design into a Printed Wired Board design ready to be etched and formed on a substrate.

Programs automatically route conductors and locate components on a substrate using well established rules of design as well as libraries of pre-stored design modules. Once the design for a substrate or circuit has been completed, the resultant design, in a standardized electronic format may be transmitted to a fabrication facility or for fabrication.

As used in this application, the term 'circuitry' refers to all of the following:

(a) hardware-only circuit implementations (such as implementations in only analogue and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

Indeed in there is a further embodiment comprising a combination of one or more of any of the other embodiments previously discussed.

The invention claimed is:

1. An apparatus comprising an audio module configured to capture sound, the audio module comprising:

a first membrane configured to detect sound and generate a first signal based on the detected sound; and a second membrane configured to detect vibration and/or sound and generate a second signal based on the detected vibration and/or sound, the second membrane being less acoustically responsive than the first membrane; and an interface configured to send the first and second signals to a processor configured to modify the first signal on the basis of the second signal so as to remove unwanted vibrations and/or sounds from the first signal;

wherein the first membrane and the second membrane are disposed adjacent to each other on a same substrate.

2. The apparatus according claim 1, wherein the processor is configured to modify the first signal on the basis of the second signal by subtracting the second signal from the first signal.

3. The apparatus according to claim 1 wherein the unwanted vibration and/or sound that the second membrane is configured to detect comprises one or more of the following: vibrations of the apparatus, wind noise, handling of the apparatus and unwanted sound.

4. The apparatus according to claim 1 wherein the second membrane is less acoustically responsive than the first membrane due to the second membrane being at least one of:

responsive to one or more different frequency ranges relative to the first membrane, and tuned to one or more frequency ranges of unwanted vibrations.

5. The apparatus according to claim 1 wherein the interface comprises a first interface for sending the first signal on a first channel to the processor and a second interface for sending the second signal on a second channel to the processor.

6. The apparatus according to claim 1 wherein the processor is further configured to align the phases of the first signal and the second signal.

7. The apparatus according to claim 1 wherein the processor is further configured to align amplitudes of the first signal and the second signal.

8. The apparatus according to claim 1 wherein the second membrane is less acoustically responsive than the first membrane due to a higher stiffness of the second membrane relative to the first membrane.

9. The apparatus according to claim 1 wherein the first signal is from at least one audio source and the second signal is from at least one other source other than the audio source.

10. The apparatus according to claim 1, wherein the processor is disposed on the same substrate as the first membrane and the second membrane.

11. The apparatus according to claim 1, wherein the audio module further comprises an amplifier disposed on the same substrate as the first membrane and the second membrane, and the processor is not disposed on the same substrate.

12. The apparatus according to claim 1, wherein the second membrane is less acoustically responsive than the first membrane due to a physical cover over the second membrane that acoustically isolates the second membrane from an environment of the first membrane.

13. The apparatus according to claim 12, wherein the physical cover seals the second membrane from the first membrane.

14. The apparatus according to claim 13. wherein there is at least a partial vacuum between the physical cover and the second membrane.

15. The apparatus according to claim 14, wherein the first membrane and the second membrane have substantially identical audio sensitivities, and the at least partial vacuum substantially equalizes audio sensitivity of the second membrane with audio sensitivity of the first membrane.

16. The apparatus according to claim 1, wherein the interface comprises a single data line comprising two channels for the respective first signal and second signal.

17. The apparatus according to claim 1, further comprising a switch configured to selectively block the second signal:

in response to a manual user input, and/or automatically when a level of the second signal is less than a prescribed threshold.

18. A method comprising:

detecting sound with a first membrane in an audio module;

generating a first signal based on the detected sound;

detecting vibration and/or sound with a second membrane in the audio module, the second membrane being less acoustically responsive than the first membrane and wherein the first membrane and the second membrane are disposed adjacent to each other on a same substrate;

generating a second signal based on the detected vibration and/or sound; and sending the first and second signals to a processor configured to modify the first signal on the basis of the second signal so as to remove unwanted vibrations and/or sounds from the first signal.

19. The method according to claim 18 wherein the method comprises modifying the first signal on the basis of the second signal.

20. The method according to claim 19 wherein the modifying comprises subtracting the second signal from the first signal.

21. The method according to claim 19 wherein the modifying comprises aligning at least one of:

phases of the first signal and the second signal; and amplitudes of the first signal and the second signal.

* * * * *